United States Patent [19]

Leenders

[11] Patent Number: 4,484,712

[45] Date of Patent: Nov. 27, 1984

[54] APPARATUS FOR ORTHOCYCLICALLY WINDING COILS

[75] Inventor: Wilhelmus H. A. Leenders, Bemmel, Netherlands

[73] Assignee: Stichting Research en Techniek van de Katholiek Universiteit, Toernooiveld, Netherlands

[21] Appl. No.: 347,047

[22] Filed: Feb. 8, 1982

[30] Foreign Application Priority Data

Feb. 16, 1981 [NL] Netherlands ..... 8100746

[51] Int. Cl.[3] ..... B65H 54/00

[52] U.S. Cl. ..... 242/25 R; 140/92.2; 242/7.15; 242/158 R

[58] Field of Search ..... 242/25 R, 158 R, 158.2, 242/158.3, 158.4 R, 158.4 A, 158.5, 7.15, 7.16; 140/92.2

[56] References Cited

U.S. PATENT DOCUMENTS

| | | | |
|---|---|---|---|
| 1,504,004 | 8/1924 | Vienneau | 242/7.15 |
| 1,504,005 | 8/1924 | Vienneau | 242/7.15 X |
| 1,865,236 | 6/1932 | Daniels | 242/25 R X |
| 3,237,875 | 3/1966 | Van Der Hoek et al. | 242/158.2 X |
| 3,833,184 | 9/1974 | Hara et al. | 242/158 R |
| 3,951,355 | 4/1976 | Morioka et al. | 242/158 R |
| 4,244,539 | 1/1981 | Taneda et al. | 242/158 R |

FOREIGN PATENT DOCUMENTS

| | | | |
|---|---|---|---|
| 2370669 | 7/1978 | France | 242/25 R |
| 47172 | 4/1977 | Japan | 242/158.2 |
| 82768 | 7/1981 | Japan | 242/25 R |
| 2073264 | 10/1981 | United Kingdom | 242/25 R |

*Primary Examiner*—Stanley N. Gilreath

*Attorney, Agent, or Firm*—Scully, Scott, Murphy & Presser

[57] ABSTRACT

An apparatus for, orthocyclically winding coils, in which a wire is wound about a core in such a manner that each winding extends at right angles to the axis of the core for the major part of its circumference, successive windings are virtually in contact with each other, and series of succcessive windings define layers of windings. According to the invention the first layer is wound with great precision by supplying the wire at an angle slightly different from the orthogonal feed-in position, and guiding it down to the core by means of a wire depositing member. After the first layer has been wound, an end flange is positioned, the wire depositing member is swung out of position, and subsequent layers are wound on the first layer by feeding the wire to the core in an orthogonal position.

4 Claims, 6 Drawing Figures

1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48

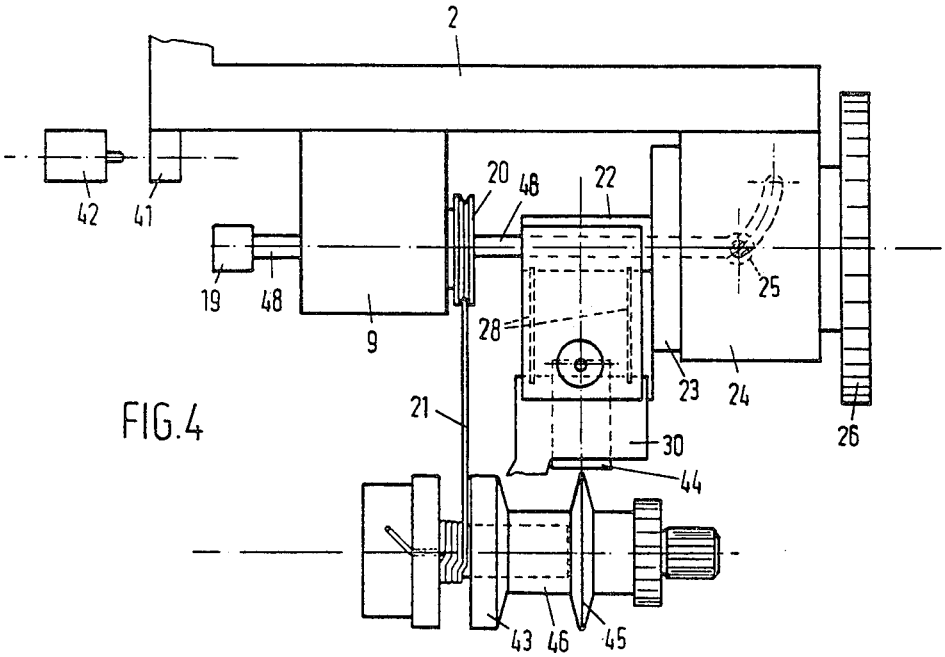
FIG.4
FIG.5
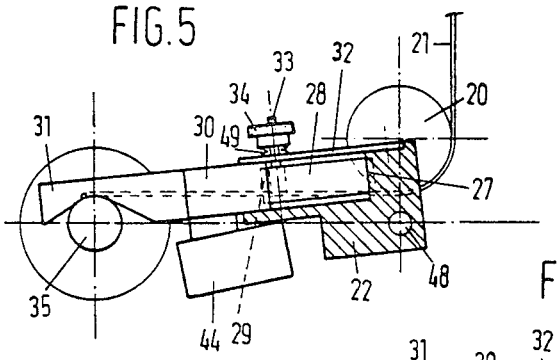
FIG.6
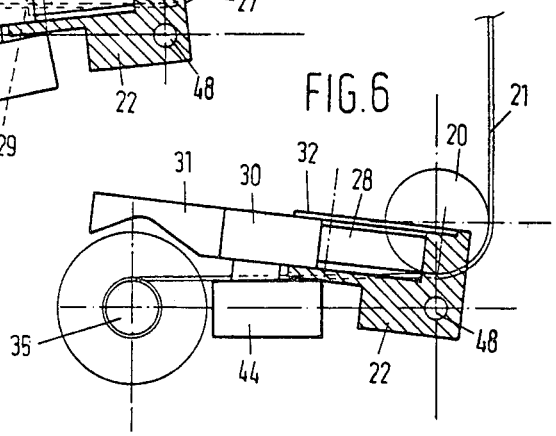

APPARATUS FOR ORTHOCYCLICALLY WINDING COILS

This invention relates to an apparatus for mechanically orthocyclically winding coils, in which a wire is wound about a core in such a manner that each winding extends at right angles to the axis of the core for the major part of its circumference, successive windings are virtually in contact with each other, and series of successive windings define layers of windings, for which purpose the wire is guided from a wire guide to the core, which wire guide is moved incrementally longitudinally of the core during winding. The invention further relates to apparatus for orthocyclically winding coils, comprising a holder for a core to be wound, and a wire supply mechanism in spaced relationship to said holder, said wire supply mechanism comprising a wire guide and means for moving said wire guide incrementally in the longitudinal direction relative to said holder, and means for revolving a core to be held in said holder about its axis.

A similar apparatus is known from an article in "Philips Technisch Tijdschrift", Vol. 23, 1961, No. 12, pp 381–395. According to this article, it is extremely important for the first layer of windings to be properly applied to the core. If the first layer is in proper position, it is sufficient for the wire to be orthocyclically fed-in during winding. In the prior apparatus, the wire is kept in an orthogonal position relative to the core by means of a feed-in wheel. The wheel moves along with the winding movement, and is given a cam push at intervals for the wire to move incrementally relatively to the core. The winding of the first layer turns out to be not quite feasible in practice by means of the apparatus described, owing to involuntary movements of the wire resulting from the occurrence of vibrations and variations in tension in the wire. In practice, therefore, the first layer is laid and checked laboriously winding by winding, which often requires manual correction. It will be clear that, with a first layer that may consist of tens to hundreds of windings, this is a time-consuming matter.

It is an object of the present invention to improve the prior apparatus so that the first layer of windings may be laid mechanically with great accuracy and effectiveness. A further object of the invention is to provide apparatus in which, after the winding of the first layer, a confining flange is positioned so accurately at one end of the core to be wound that subsequent layers are laid down in the correct place without any problems.

The purpose set is achieved according to the invention with an apparatus in which, for the winding of the first layer of windings, the wire is supplied at an angle slightly different from the orthogonal feed-in position, and is guided up to the core by means of a wire depositing member. The apparatus according to the invention comprises a wire depositing member connected with the wire supply mechanism, and extending from said wire supply mechanism in the direction of the core holder, with the end of said wire depositing member in proximity of, and above the core holder, the arrangement being such that, in operation, a wire extending from the wire supply mechanism to a core to be wound is pressed and held on said core by said end at an angle differing slightly from an orthogonal feed-in position, and with a certain tension, said wire depositing member being also coupled with the means for moving the same incrementally longitudinally of the core holder.

In the apparatus according to the invention, during the winding of the first layer of windings, the wire supply mechanism is held in such a position relative to the core being wound that the wire is held by the wire depositing member at an angle differing slightly from an orthogonal feed-in position. Thus, for example, the wire makes an angle of approximately 7° relative to the orthogonal feed-in position, which value is a maximum value, which will depend partly on the thickness of the wire and the diameter of the coil. Owing to the position of the wire and the wire depositing member, and owing to the form of the latter, a resultant in the downward direction is created, so that the wire is positively held on the core by the wire depositing member. The wire depositing member has the form of a spatula or thumb-shaped body extending in the direction of the core to be wound, and connected with the wire supply mechanism with a certain friction, so that the wire always remains pressed against the side of the spatula, and no shortage of interspace between a laid winding and the wire depositing member arises. This makes it possible to compensate for any minor variations in thickness, which will inevitably occur in the wire. In the case of undue irregularity in wire thickness, the wire interspace may become negative. According to the invention, this problem is solved by the wire depositing member being subjected to a shift owing to the frictional connection for it to continue from the new position with depositing the wire with the desired interspace. Accordingly, if necessary the wire depositing member can automatically re-adjust itself.

In a preferred embodiment of the apparatus according to the invention, the wire depositing member and the wire supply mechanism are coupled together in such a manner that, when the wire depositing member moves away from the core being wound, the wire supply mechanism occupies a position from which a wire is orthogonally supplied to the core. Furthermore, the wire depositing member is preferably provided with a detector coupled to a means for positioning an end flange. Quite suitably, said detector may be a magnetic transducer with the end flange being connected to a body having a collar with a sharp edge, to which collar edge the magnetic transducer is responsive. Such a magnetic transducer, which operates without contacts, is known by the name of magnetoswitch. Other detectors, such as mechanical or optical switches are also suitable.

The various parts of the apparatus according to the invention may be coupled to suitable electronic operating means, which coordinate and control the various movements of the parts.

The invention will now be described with reference to the accompanying drawings, in which:

FIG. 4 is a similar view to illustrate the positioning of an end flange;

FIG. 5 is a side-elevational view of the wire depositing member of the apparatus according to the invention in operation; and FIG. 6 is a view of the wire depositing member after it has been swung away and the detector for positioning the end flange has been brought in position.

Figure 1:
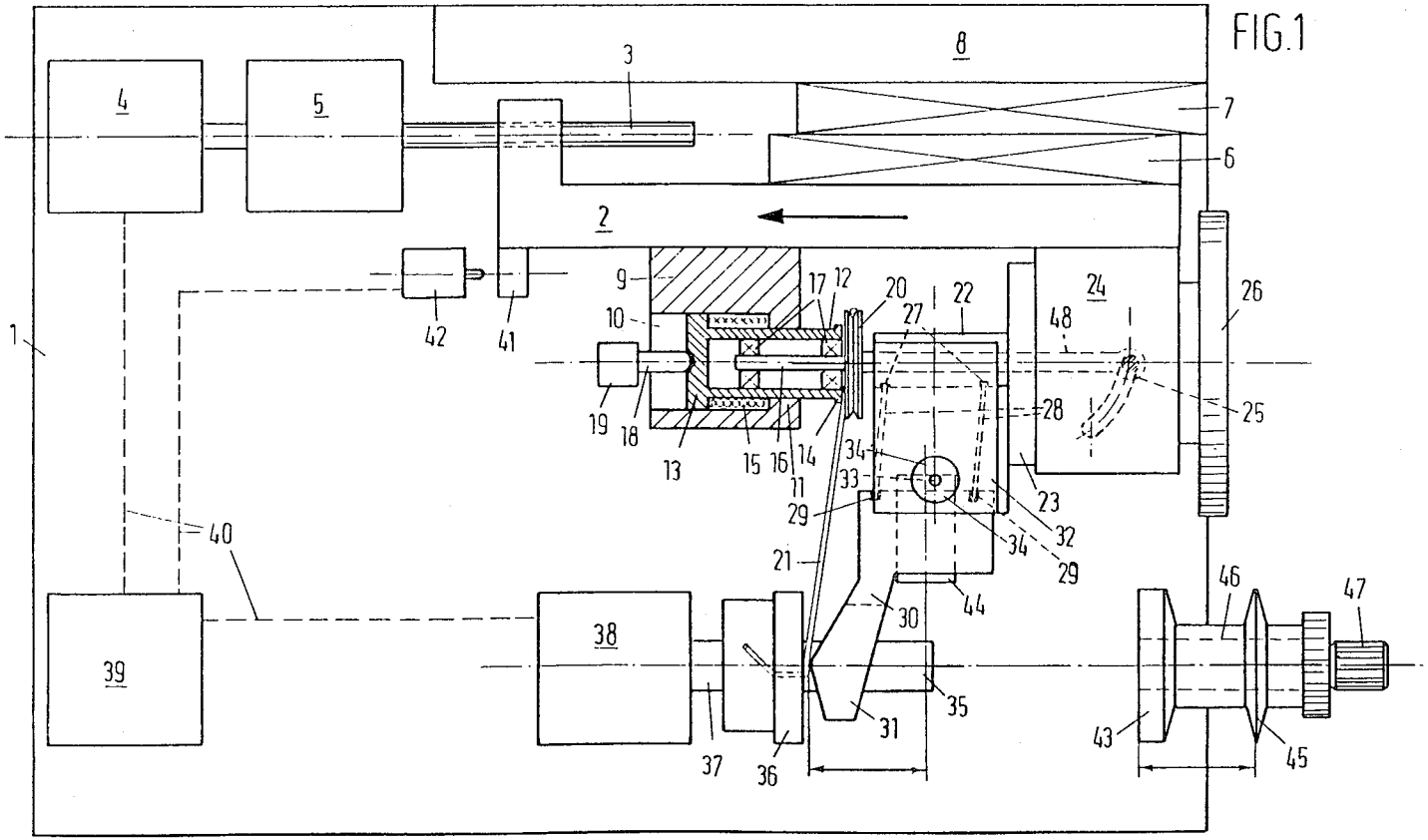
FIG. 1 is a diagrammatic illustration of one embodiment of the apparatus according to the invention in top plan view, with some parts being partially shown in cross-section.

FIG. 1 shows an embodiment of the apparatus according to the invention in top plan view. The various parts of the apparatus are all mounted on a base or table 1. The actual wire supply mechanism, which moves incrementally during the winding of the coil, consists of an essentially L-shaped beam 2, the short side of which is connected to a ball spindle or ball screw 3. Ball screw 3 is driven by a suitable motor 4, shown as a block, with suitable reduction gearing 5, indicated as a block, being provided between motor 4 and L-beam 2. Motor 4 is operative to move the beam in the direction of the arrow and in the opposite direction. In order that the movement may take place accurately in the direction indicated, a guide plate 6 is secured to beam 2, which plate slides along a similar guide plate 7 secured to beam 8, beam 8 being secured to table 1 in an upright position. Plates 6 and 7 together form a so-called rectilinear guide.

Secured to beam 2, on the side remote from that where guide plate 6 is mounted, is a holder body 9, having a cylindrical passage 10. At one end, the cylindrical passage 10 is narrowed by an internal flange 11. Mounted for movement within the cylindrical passage 10 is a cylinder 12. Cylinder 12 has an outside diameter virtually equal to the inside diameter of the passage at internal flange 11. Cylinder 12 is provided at one end with a flange 13 having an outside diameter virtually equal to the inside diameter of the cylindrical passage 10. At its other end, cylinder 12 is provided with a flange 14. In the space defined by cylinder 12 and the cylindrical passage 10, and by flange 13 and internal flange 11, a spring 15 is provided. In the position of cylinder 12 as shown, spring 15 is compressed between flange 13 and internal flange 11. If cylinder 12 should not be retained in the manner to be described hereinafter, spring 15 would ensure that cylinder 12 moves in passage 10 and within flange 11 in such a manner that the side face of flange 14 is in alignment with the side face of holder body 9. In cylinder 12 a shaft 16 is held, which is journalled along the centre line of cylinder 12 by means of two ball bearings 17. A pin 18 presses against flange 13 on cylinder 12. Pin 18 is connected via an actuating dog or bridge member 19 to a drawbar 48 extending parallel to shaft 16 along the underside of holder body 9.

Secured to shaft 16 is a wheel 20. Wire 21 is supplied over wheel 20 from a supply wheel or the like not shown. Drawbar 48 extends through the base body 22 of a wire depositing member into cylinder 23, which is arranged for rotation in holder body 24 secured to the L-shaped beam 2. Arranged within cylinder 23 is a displacement mechanism 25 for axially displacing drawbar 48. A manually operable wheel 26 is secured to cylinder 23. By turning handwheel 26 first the displacement mechanism 25 is put into operation by rotation through approximately 180° . Thereafter, cylinder 23 rotates along with it, and so does the base body 22 of the wire depositing member, secured to cylinder 23. When handwheel 26 is operated so that the base body 22 is moved upwards, the displacement mechanism 25 ensures during the first rotation through approximately 180° that, before base body 22 moves upwards, wheel 20 can move to the left in the drawing under the influence of the action of spring 15. When handwheel 26 is operated so that base body 22 is moved downwards, during the first rotation through approximately 180° the displacement mechanism 25 has ensured that, before base body 22 moves downwards, wheel 20 can move to the right in the drawing.

Displacement mechanism 25 can be any one of a number of known conventional attachment structures to produce the two stage movement discussed above. As shown in FIG. 1, drawbar 48 is interconnected with the displacement mechanism 25 which is positioned in a helical guideway so that it can travel along approximately a 180° path. Thus, there is limited relative axial movement as the handwheel 26 is rotated until the mechanism 25 reaches either one or the other end of the guideway. At that time, the relative axial movement is replaced by a cooperative rotational movement. Thus, by turning handwheel 26 in the clockwise direction in FIG. 1, the displacement mechanism 25 will be guided along the helical slot with right to left axial movement of shaft 48 and interconnected components therewith. Thereafter, when the mechanism 25 reaches the end of the helical slot, continued rotation of wheel 26 will carry mechanism 25 along and produce corresponding rotational movement thereof and of the interconnected structure.

The wire depositing member is shown in cross-section in FIG. 5. Base body 22 has the shape of an L. Provided on the inside of the short leg of the L of the base body 22 are two spaced slots 27, into which extend to vertically disposed leaf springs 28. At the other end, springs 28 extend into two slots 29 in the actual depositing body 30, which is provided with a thumb or spatula 31. A cover plate 32 is laid on base body 22, leaf springs 28 and depositing body 30 to hold down the assembly by the action of a screw 33 secured to the L-shaped base body 22, with an adjusting nut 34 and a spring 49 under nut 34. Owing to the construction shown, the depositing member 30 can slightly move laterally relatively to base body 22 in cases when the thumb or spatula 31 is subjected to heavier loads than the friction on depositing body 30 adjusted by adjusting nut 34.

The thumb or spatula 31 of depositing body 30 keeps wire 21 down on core 35, which core is provided on one end with a flange 36, and is connected through a shaft 37 with the winding motor 38 shown as a block. The spatula or thumb 31 is provided, as shown in FIG. 5, with a recess accommodating core 35. The operation of the winding motor 38 and motor 4 is controlled by a microprocessor 39, shown as a block, and connected through electrical wire 40 to these motors.

Figure 2:
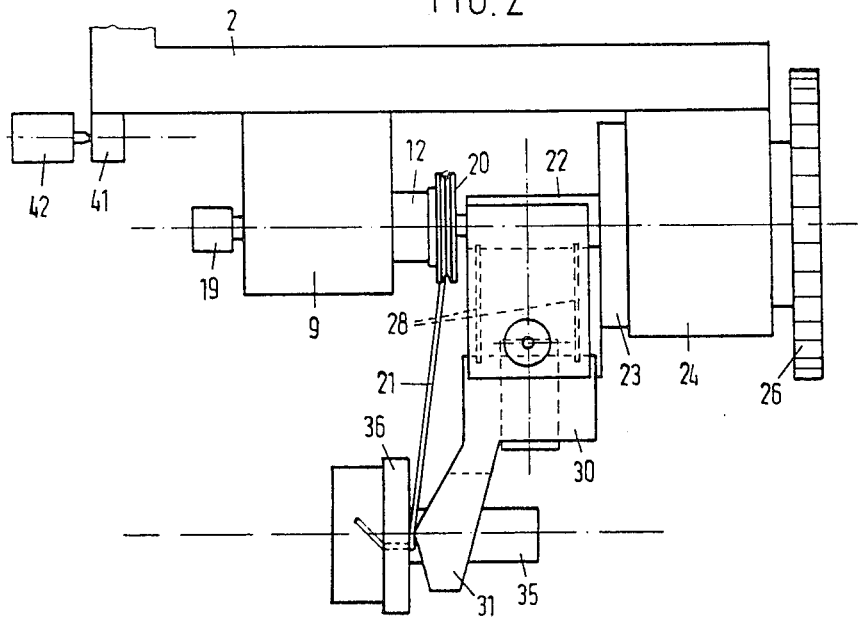
FIG. 2 is a top plan view, showing the most important parts of the apparatus shown in FIG. 1 at the beginning of a winding pass.
Figure 3:
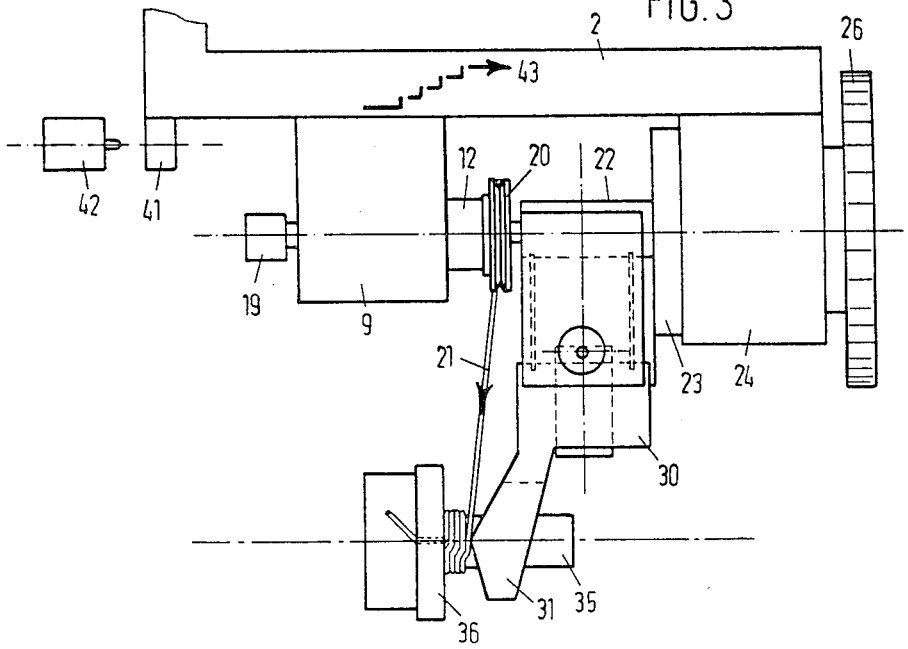
FIG. 3 shows a similar plan view after some windings have been laid.

The operation of the apparatus according to the invention is illustrated in the light of FIGS. 1, 2 and 3. As shown in FIG. 1, a wire is passed over feed-in wheel 20 to core 35, and fastened in some suitable manner to flange 36. The wire depositing member is moved to the left until the thumb or spatula 31 holds wire 21 on flange 36. Subsequently the entire wire supply mechanism is moved to the left with L-shaped beam 2 until a projection 41 on the left-hand end of beam 2 comes into contact with a microswitch 42, which is also connected through an electrical wire 40 to microprocessor 39. As shown in FIG. 2, during the last part of the movement of beam 2 to the left, the depositing body 30 slides to the right, against the frictional force, between, and relatively to, base body 22 and cover plate 32, inasmuch as thumb 31, which holds wire 21 against flange 36, or the previously wound turn of wire cannot be moved further.

As soon as microswitch 42 makes contact with projection 41 on L-shaped beam 2, a signal is passed to microprocessor 39, which subsequently actuates motor 4 from the operating position then brought about, and winding motor 38. Winding motor 38 ensures that core 35 is rotated and wire 21 is wound on the core. Each time after the virtual completion of the laying of one winding, motor 4 causes L-shaped beam 2 to move incrementally to the right a distance equal to the thickness of wire 21 plus approximately 3%. This thickness has previously been entered into microprocessor 39 as a data. Thumb 31 of the wire depositing member ensures that wire 21 is laid on core 35 in the correct position. If the wire exhibits excessive variations in thickness (greater than 3% of the thickness), jamming of the wire between the preceding winding and thumb 31 is prevented by virtue of the wire depositing member 30 moving to the right against the frictional action of cover plate 22 on wire depositing member 30, because thumb 31 then pushes itself off against the winding already laid. The incremental movement of L-shaped beam 2 is indicated in FIG. 3 by the steps next to arrow 43.

When the number of windings previously entered into microprocessor 39 has been laid, microprocessor 39 stops the operation of winding motor 38 and stops the operation of motor 4 after thumb 31 has moved a further distance equal to half the wire thickness. Subsequently wheel 26 is operated by hand, so that the wire depositing member is moved upwards as shown in more detail in FIGS. 4 and 6. During this movement, the internal displacement mechanism 25 is actuated too, owing to which, via drawbar 48, bridge member 19 and pin 18, cylinder 12 moves to the left under the influence of spring 15, so that the supply wheel 20 is displaced and wire 21 comes to extend orthogonally to core 35. Subsequently the end flange 43 on the end of core 35 is moved up to a small distance from the winding last laid. This distance is preferably equal to half the wire thickness, so that a next layer of windings is laid on the first layer of windings as evenly as possible.

The location of the end flange is effected, according to the invention, in a suitable manner by means of a detector 44 secured to the wire depositing member. This detector may, for example, be a magnetic transducer secured to the wire depositing member in such a manner that, after the wire depositor has moved upwards, the detector is right in front of core 35, as shown in FIG. 6. The end flange 43 is connected in a suitable manner to an applicator 46 provided with a collar 45 with a sharp edge, and spaced such a distance from end flange 43 that, when the sharp edge of collar 45 is right in front of the detector, the front face of flange 43 is spaced from the last winding a distance exactly equal to half the thickness of the wire. For accurate positioning, applicator 46 may be provided with fine-adjustment means 47.

Positioning of the end flange can be accomplished by use of any of a variety of well known conventional procedures. The details of an appropriate apparatus for this purpose is not depicted in the schematic view of FIG. 1. Of course, alternatively, the end flange could be manually positioned over core 35 in a conventional manner. In any event, it has been found convenient to have a sliding carrier for directing the end flange along a line corresponding to the axis of core 35. The end flange 43 is provided with an opening, as shown, so that it slides over core 35. A rough positioning can take place by moving the apparatus including parts 43, 45, 46, and 47 by hand toward core 35. The fine adjustment means 47 is provided to direct the sharp edge in the center of collar 45 in front of the detector 44. This is a conventional type of well known fine-adjustment means such as that used in a conventional micrometer gauge. It moves applicator 46 with collar 45 and end flange 43 at the left hand end of applicator 46 very slowly and accurately along the sliding carrier mechanism in a conventional manner.

Characteristic features and advantages of the method and apparatus according to the invention are that at the beginning of the winding operation the wire depositing member is automatically adjusted to the correct position. Subsequently, during the laying of the first layer of windings, which must be done highly accurately with maximum interspaces between the windings of approximately 3% of the wire thickness, the wire is guided down to the coil core. The wire is subsequently held down on the coil core with a certain tension, and follows the orthocyclic deposition pattern imposed by the longitudinal displacement of the wire depostiing member, which is preferably controlled by electronic means. During the deposition of the first layer, the position of the wire depositing member is automatically adjusted if the wire supplied exhibits a local deviation in thickness. The end flange is positioned without any problems by virtue of the use of a highly accurate flange position detector secured to the wire depositing member. When a magnetic transducer is used, accuracies in the order of 1 micrometer are attainable. For laying the subsequent layers, the wire is supplied by the supply wheel without the intermediary of the wire depositing member, which supply wheel automatically comes to occupy the correct position when the wire depositing member is swung away.

The leaf spring construction in the wire depositing member is preferred. By means of this construction the spatula or thumb is capable of stable and parallel deflection free from play. A different construction could be used, however.

In side view the wire being wound does not extend fully parallel to the wire depositing member, so that the wire is subjected to downward pressure. The promotes its being held down on the core.

I claim:

1. Apparatus for orthocyclically winding coils, comprising; support means adapted to have a core to be wound rotatably mounted thereon, a wire supply mechanism in space relationship with respect to said support means, said wire supply mechanism including a wire guide and means for moving said wire guide incrementally in the longitudinal direction relative to said support means, means for revolving a core about its axis while held by said support means, a wire depositing member connected with the wire supply mechanism and extending from said wire supply mechanism in the direction of said support means, said wire depositing member having an end in proximity of and above the support means, said wire supply mechanism, said support means, and the wire depositing member being arranged with respect to one another so that in operation a wire extending from the wire supply mechanism to a core to be wound is pressed and held on said core by said end at an angle differing slightly from an orthogonal feed-in position and with a certain tension, and said wire depositing member being also coupled with the means for moving said wire guide incrementally longitudinally of the support means.

2. Apparatus according to claim 1 wherein the wire deposting member is movably mounted so as to be movable toward and away from the core, means is provided to move the wire depositing member toward and away from the core, and means is provided to couple the wire depositing member and the wire supply mechanism together so that when the wire depositing member moves away from the core being wound, the wire supply mechanism takes up a position from which a wire is orthogonally supplied to the core.

3. Apparatus according to claim 1 or 2 wherein the wire depositing member includes a detector.

4. Apparatus according to claim 3 wherein the detector is a magnetic transducer.

* * * * *